US008777513B2

(12) United States Patent
Devitt

(10) Patent No.: US 8,777,513 B2
(45) Date of Patent: Jul. 15, 2014

(54) HYDRAULIC BOAT HOIST

(71) Applicant: Jon W. Devitt, Ida Grove, IA (US)

(72) Inventor: Jon W. Devitt, Ida Grove, IA (US)

(73) Assignee: Midwest Industries, Inc., Ida Grove, IA (US)

( * ) Notice: Subject to any disclaimer, the term of this patent is extended or adjusted under 35 U.S.C. 154(b) by 64 days.

(21) Appl. No.: 13/658,432

(22) Filed: Nov. 26, 2012

(65) Prior Publication Data

US 2014/0147208 A1 May 29, 2014

(51) Int. Cl.
*B63C 1/08* (2006.01)

(52) U.S. Cl.
USPC ..... 405/3; 114/44

(58) Field of Classification Search
USPC ..... 405/3, 4; 114/44, 45
See application file for complete search history.

(56) References Cited

U.S. PATENT DOCUMENTS 6,823,809 B2 11/2004 Hey
6,976,442 B2 12/2005 Hey et al.
7,246,970 B2 7/2007 Hey
7,371,055 B2 5/2008 Dhashi et al.
7,383,781 B1 6/2008 Griffin
7,407,150 B1 8/2008 Bellantoni
7,413,378 B2 8/2008 Way
7,455,026 B2 11/2008 Towley, III et al.
7,509,916 B1 3/2009 Nelson, Jr.
7,547,159 B1 6/2009 Warters
7,607,644 B1 10/2009 Gibb et al.
8,061,932 B1 11/2011 Latham
8,267,621 B1 9/2012 Way

OTHER PUBLICATIONS

No Profile Boat Lifts Users Manual, Way Marine Design, Inc., St. Augustine, FL, USA.
No Profile Boat Lifts Installation Considerations, Electrician Drawings, Way Marine Design, Inc., St. Augustine, FL, USA.

*Primary Examiner* — Tara M. Pinnock
(74) *Attorney, Agent, or Firm* — Sturm & Fix LLP

(57) ABSTRACT

A hydraulic boat lift uses two hydraulic cylinders to pull/release cables attached to a boat cradle. The hydraulic cylinders are operated by attachment to a tandem pump to cause them to operate in a synchronized fashion. Furthermore a switch assembly has a switch associated with each respective hydraulic cylinder, the pair of switches being wired in parallel so that if one side of the boat cradle reaches its fully raised position before the other side, the one side will stop and the other side will continue to move up until it is also disposed in a fully raised position before stopping by turning off the electricity to the tandem pump.

9 Claims, 14 Drawing Sheets

Fig 5
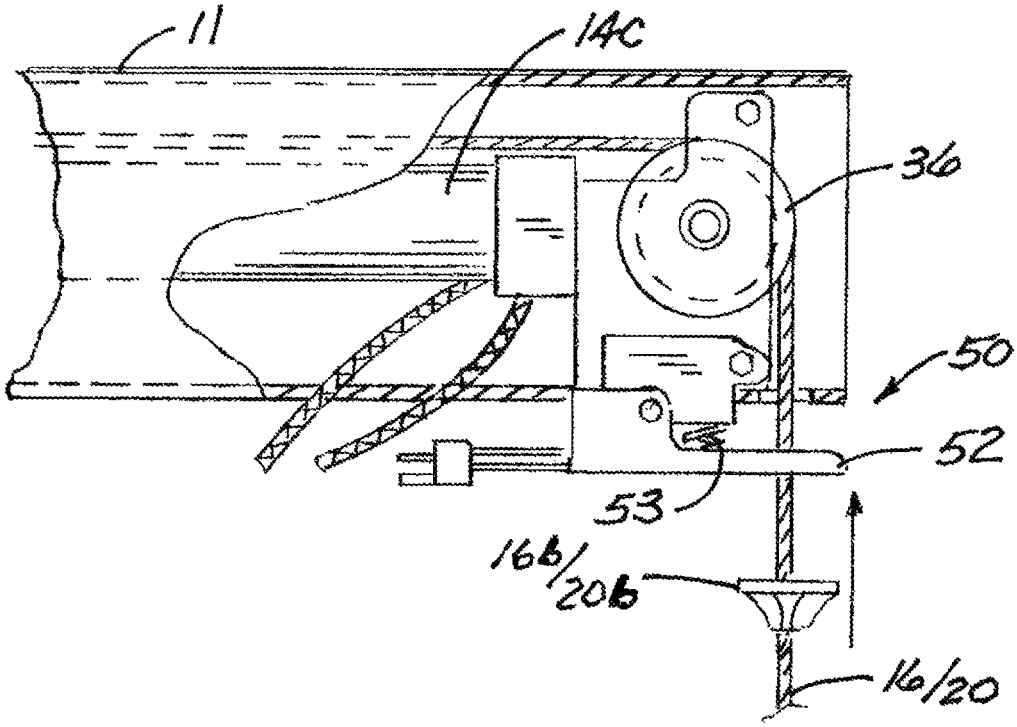
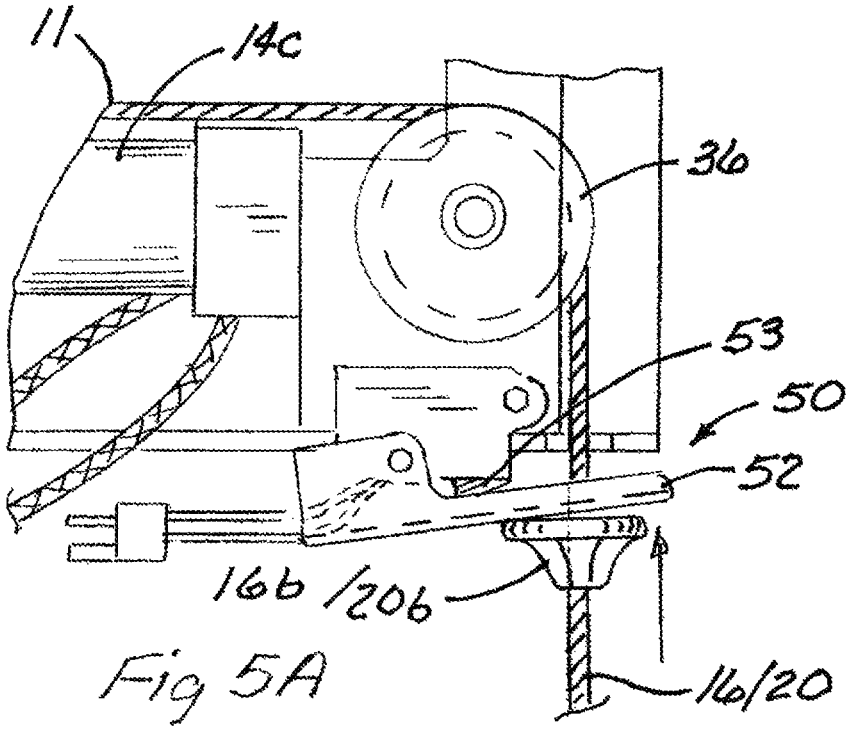
Fig 5A

HYDRAULIC BOAT HOIST

TECHNICAL FIELD

This invention relates generally to boat hoists and more particularly to a boat hoist for use on piling posts secured to the bottom of the body of water and/or boat houses built on such pilings.

BACKGROUND

Hydraulically actuated boat hoists are shown in U.S. Pat. No. 6,823,809 to Hey, U.S. Pat. No. 6,976,442 to Hey U.S. Pat. No. 7,246,970 to Hey, U.S. Pat. No. 7,413,378 to Way and U.S. Pat. No. 8,267,621 to Way, all of which are incorporated herein by reference in their entirety.

Southern U.S. States and coastal regions commonly use one of these three methods to store/moor boats: (1) Moor the boat to a fixed or floating pier using ropes. In this case, the boat remains in the water, (2) lift the boat using a platform or sling type lift mounted to a set of pilings or roof structure mounted on pilings, or (3) lift the boat using a floating lift system. The most common method used depends on the region and regulations governing the body of water. Many reservoirs do not allow private ownership of waterfront property. In these lakes, there tends to be large marinas or "dockominum" structures. In these structures in-water mooring is the most common. A small percentage of the boats are lifted using a floating lift. Floating lifts are usually the only type allowed on a large dock structure. Marina managers discourage any structure being fixed to these floating systems.

Many lakes and waterways allow private waterfront ownership. In these cases, a permanent, fixed pier can be installed. Often a permanent roof structure is built over the slip intended for the boat commonly called a "boat house". When these structures are present, a large percentage will have a mounted lift system. Some permanent docks do not have a roof structure. A lift is usually mounted on the top of large pilings when no roof is present.

Pile and roof mounted lift systems have been around for decades. The lift designs are basically the same. Galvanized poles are mounted in bearings hanging from a beam in the roof or a beam mounted along the pilings. A "plate-gear" motor is connected to the end of the pole that causes the entire pole to turn. Cables are attached to the pole and wind as the pole turns. In lower capacity, roof-mount applications, one pole can be used, but in pile mount applications and higher capacity roof-mounts, two poles and motors are used.

Some differentiation exists in the pole winding products. Some have improved on the motor and controls to included wireless operation. Some have added machined cable grooves to improve cable winding. There is even one company that uses a "level cable" technique to make a single motor/pole piling application. They also have some variation on the platform, bunks, and load guide features. Low-cost kits use a sling instead of a platform.

Pole-winders have many weaknesses that present opportunities. Cable fatigue, motor synchronization, slow speed, poor corrosion resistance, and power supply issues are a short list of issues with current products. Cable fatigue is in a guaranteed failure mode if cables are not replaced every 2-3 years, depending on frequency of use. All of the designs on the market use wire rope. The galvanized poles used in these designs cause rapid fatigue of the cables because of the small winding diameter. Compounding the issue is the large lift height requirement for most installations. It is common to lift the boat 6-10' to accommodate the fluctuating water heights.

This requires many winds on the pole and in most cases, the cable winds over itself. This not only fatigues the cable, but also damages the individual wires with the wire rope.

Cable failure modes are severe and cause the boat to fall in one direction endangering people and equipment. The most common approach to avoiding this failure is to replace cables often.

Motor synchronization is also an issue in multi-pole/motor setups. Piling mount systems have at least two motors because there is no overhead structure to route cables to a single pipe. The speed of the motors will vary causing one to lift faster or slower than the other. Most systems require the user to use a switch to momentarily shut off one of the motors to allow the slower motor(s) to catch up. This requires constant user attention when lifting or lowering the boat. Compounding this issue is the slow speed of the pole winding systems. Some lifts can take over 6 minutes to lift the boat to the needed elevation above the water.

The galvanized construction of the pole winding systems is adequate for most environments, but they eventually rust as the wound areas of the poles lose their zinc coating. The bearing locations are generally welded components. Aluminum or other naturally corrosion resistant materials are avoided because of the high stresses in these areas. Cable materials are often galvanized also due to the high replacement rate. The cable will be replaced due to fatigue before corrosion becomes an issue.

Pole-winding systems are predominately A/C power systems. Piling mount systems require a long supply from the dock to the opposite motor. This can often be a 40-50' length of cord to run down from the dock, tinder the water, and back up to the opposite motor. This length is too long for a DC (12-24V) power supply to run without extremely heavy wire. The length of the circuit from the supplying A/C panel to the motors is also very long. This often creates a large voltage drop along the circuit. The voltage drop can cause the system to malfunction and reduce the life of the motor(s) in the system. Often new installations require new circuits to be installed with heavier cable.

A/C power can be dangerous system in wet environments. GFCI (ground fault circuit interrupts) are and absolute requirement on docks. Many lives have been lost due to damaged A/C circuits causing stray A/C currents in lakes and waterfronts with inadequate circuit protection. Pole winding systems are commonly used primarily because they can be easily installed in most existing structures with little modification and they are inexpensive when compared to floating or free-standing lift designs.

The vast majority of floating lift systems are called "Air Displacement" systems. Air displacement systems raise and lower a lift structure using floats. The floats are filled with air that is evacuated to allow the structure to sink. The floats are then filled using vacuum pumps to raise the structure with the boat on it.

Floating systems such as U.S. Pat. No. 6,823,809 to Hey have a few advantages over free standing and mounted lift structures. They can be used in very deep water where pile mounted systems are not an option. They can also be used in dockominium structures where a very limited structural connection is available.

U.S. Pat. No. 6,823,809 to Hey shows a boat lift that mechanically lifts the boat using a unique linkage to lift the boat without requiring air evacuation. This hydraulic system is innovative, but expensive. The system also places critical hydraulic components at the waterline. This jeopardizes the durability of the system. Those boat hoists do not require any structural connection to the pier and can be moored similarly to the boat.

But air displacement lifts require a mounted structure on the dock. As air is evacuated from the floats gravity will cause the structured to sink to the lakebed unless a structure is in place to limit the travel. This lift style does not work well in shallow areas because of the size of the floating structure.

Lift capacity of floating lift systems is determined by the amount of flotation. The float structure is also designed to allow the structure to lift the boat sufficiently above the water. As the lift capacity increases, the number of air chambers increases. Larger structures require the user to evacuate the chambers at different rates to ensure a balanced movement. Users often complain about this requirement and the difficulty controlling it.

U.S. Pat. No. 6,976,442 to Hey and U.S. Pat. No. 7,246,970 to Hey show boat lifts that use a cantilever method to lift the platform. The lift will be in the elevated position most of the time, so that in these systems, the rod surface spends most of its life exposed to the harsh marine environment. This can cause corrosion and pitting of the rod surface which will cause leaking of the hydraulic seals.

Accordingly, there is a need for a boat lift for pilings and boat houses that will overcome the aforementioned problems.

SUMMARY OF THE INVENTION

The present invention relates to a hydraulic lift system is a roof or pile-mounted lift system. The unique design uses a pair of hydraulic cylinders to pull a system of lift cables. The cable system is strung through a tube with large diameter sheaves. This design totally eliminates the cable fatigue caused by winding cables.

The hydraulic lift of the present invention is very fast—6-8 times faster than the equivalent pole winding system. The heart of the system is a tandem hydraulic power unit that creates an equal volume flow into both lift cylinders. This equal volume ensures level lifting no matter how the load is balanced on the lift platform.

One aspect of the hydraulic system of the present invention eliminates the need to run A/C power under water to other motors. The pressure from the hydraulic power unit can be delivered to multiple cylinders through hoses that can be run under water or overhead if a roof structure exists. This allows DC power to be used and eliminates the burden on the A/C supply circuit. Using a volume-leveling hydraulic system eliminates the user intervention required by multi-motor systems. Any out of synchronization that occurs is automatically corrected at the end of the lifting process with a unique pair of switches wired in parallel. This makes everyday operation fast and user friendly.

The retracting motion of the hydraulic cylinder causes the lift to rise. Boats spend the majority of the time lifted in a stored position. The lift cylinders will be retracted most of the time, protecting the rod surface from the elements. This is unique compared to other hydraulic lift systems that extend the cylinder to cantilever a lift platform. In these systems, the rod surface spends most of its life exposed to the harsh marine environment. This can cause corrosion and pitting of the rod surface with will cause leaking of the hydraulic seals, but the preferred embodiment of the present invention is immune to this type of corrosion because of the lifting principle used with the hydraulic cylinders being retracted in the raised position of the lift.

The hydraulic system is designed to allow fluid 'bypass' when a lift cylinder reaches the end of its stroke. This allows the lift cylinders to automatically 'level up'. If one cylinder fully retracts before the other, the hydraulic power unit can continue to retract the other cylinder. This auto-level function eliminates the need for a user to manually level the lift using switches to control individual motors.

BRIEF DESCRIPTION OF THE DRAWINGS

The above mentioned advantages are at least partially met through provision of the method and apparatus described in the following detailed description, particularly when studied in conjunction with the drawings, wherein:

FIG. 5 is an enlarged view of a top front end of the preferred embodiment of the hoist with parts broken away from the circled part labeled "FIG. 5" in FIG. 4 to shown an idler pulley and normally biased closed switch;

FIG. 5A is a view like FIG. 5, but showing the normally biased closed switch being opened when a button on a cable pivots a lever on the switch upwardly to open the switch;

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 11:
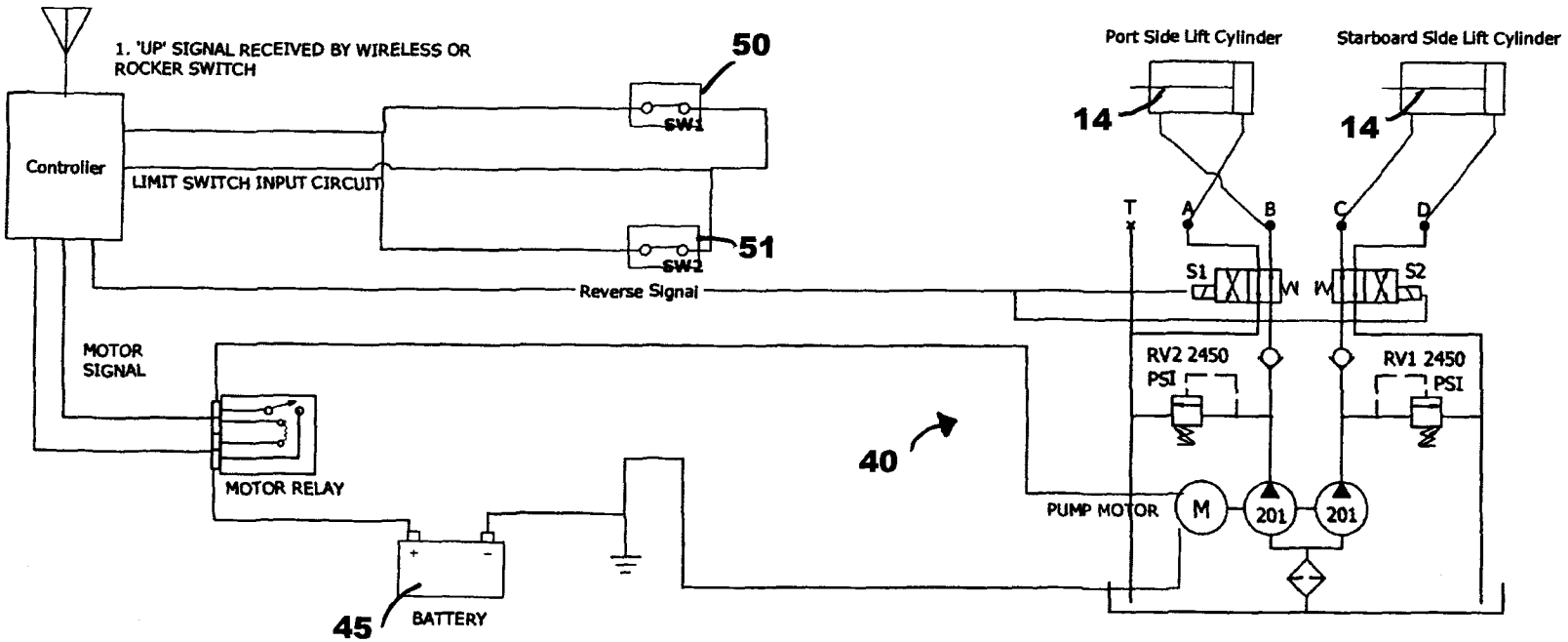
FIG. 11 is a schematic view of a tandem pump arrangement in accordance with the preferred embodiment of the present invention.
Figure 12:
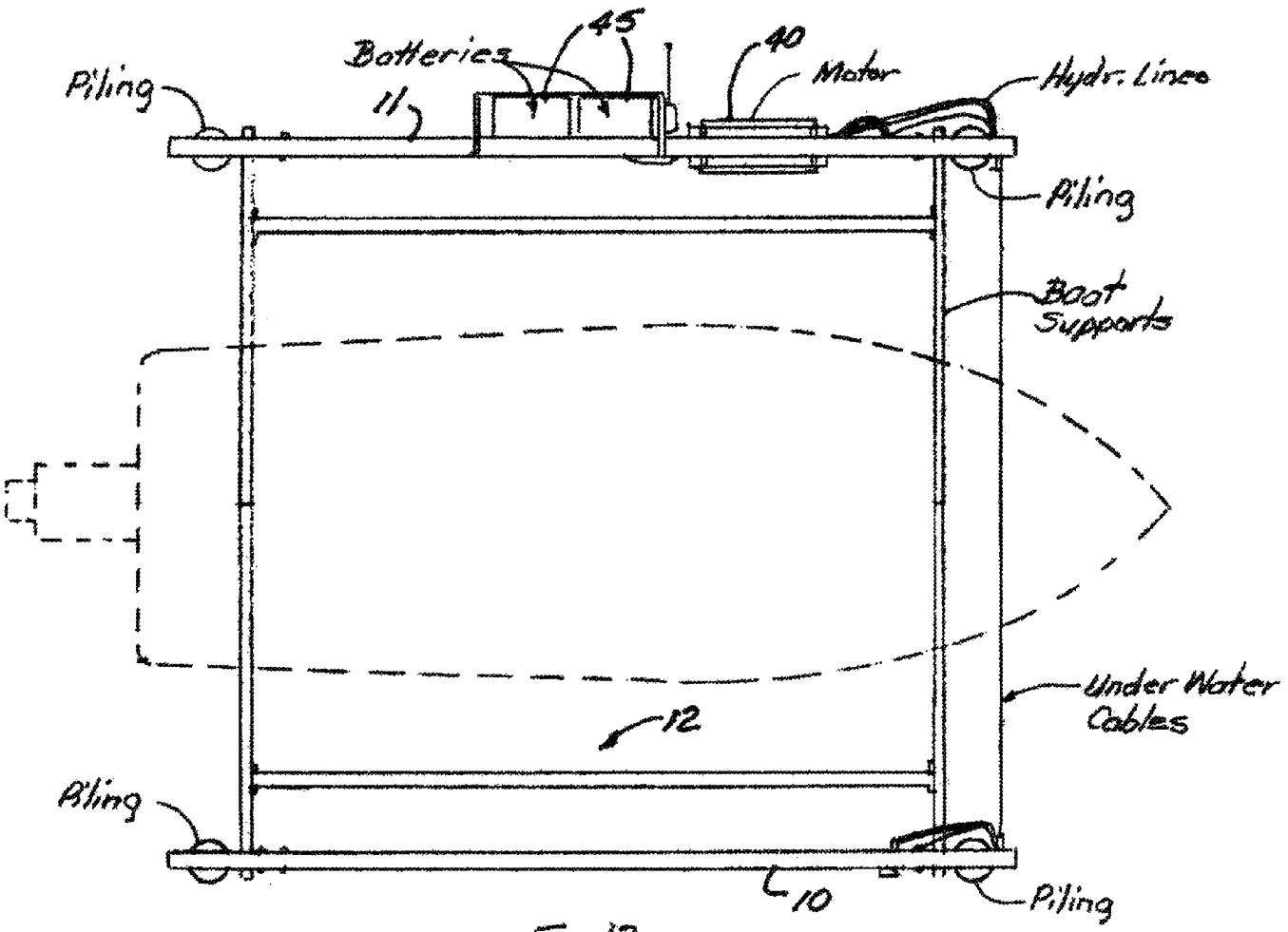
FIG. 12 is a top view in accordance with a preferred embodiment of the present invention shown attached to a pilings instead of in a boat house.
Figure 13:
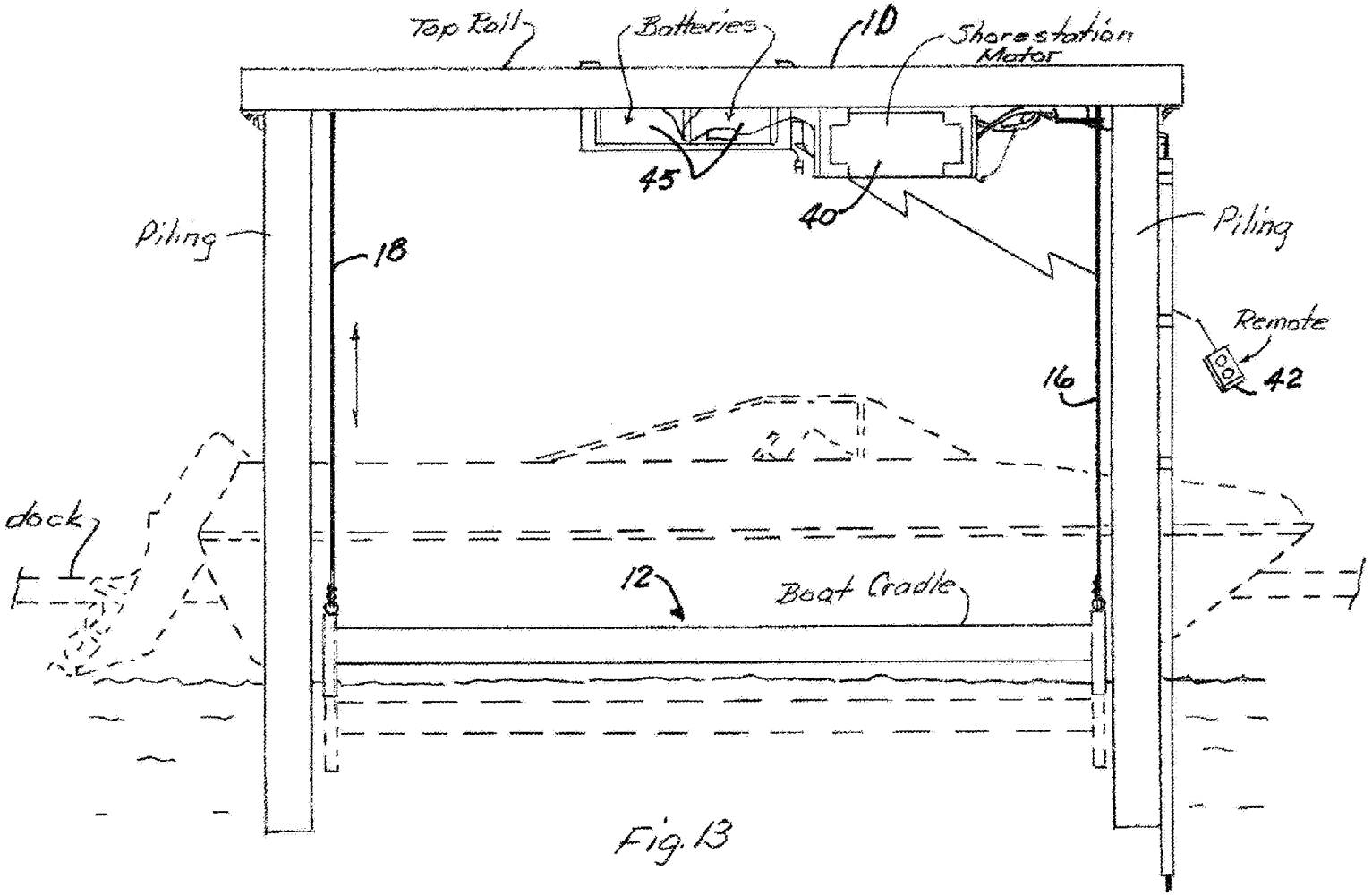
FIG. 13 is a side view of the embodiment of FIG. 12 showing the boat cradle in a raised position for storing a boat above the water level.

Referring now to the drawings, wherein like reference numerals designate identical or similar parts throughout the several views, FIGS. 1-11 and FIGS. 15-18 show a hydraulic boat hoist 10 constructed in accordance with a preferred embodiment of the invention for connection to a boat house shown in dashed lines. FIGS. 12 and 13 show the preferred embodiment attached to piers instead of to a boat house.

Figure 1:
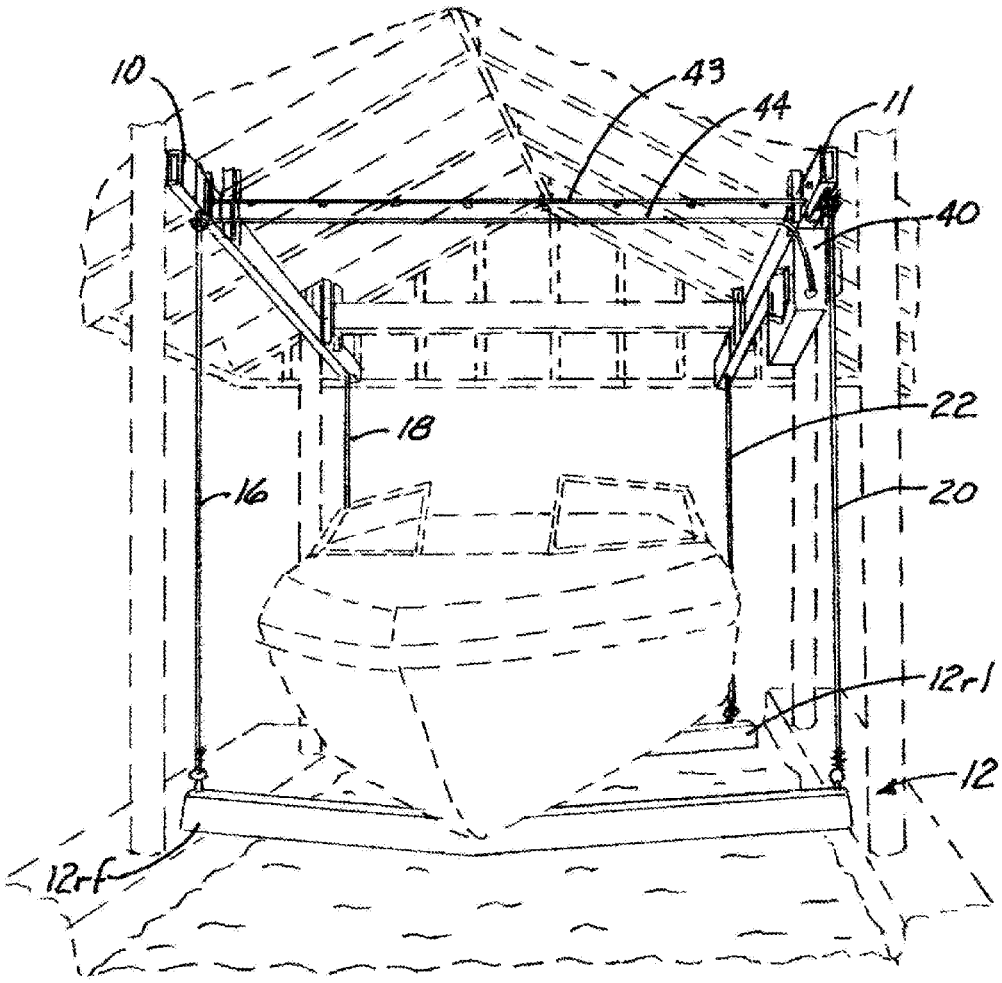
FIG. 1 is a front perspective view of a hydraulic boat hoist constructed in accordance with a preferred embodiment of the present invention installed in a boat house with the boat hoist shown in a raised, boat storage, position.
Figure 2:
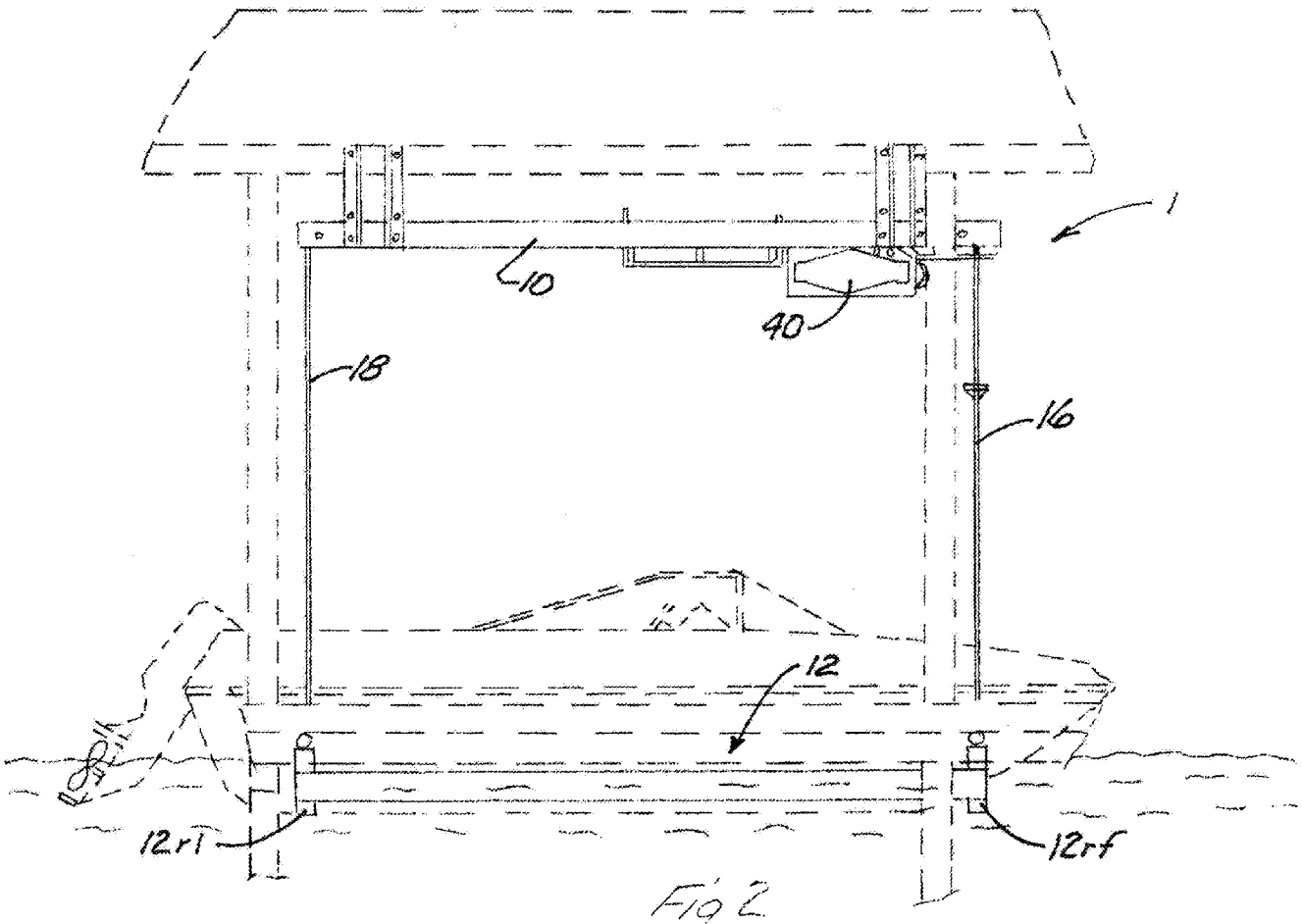
FIG. 2 is a side devotional view of the boat hoist of FIG. 1, but with the boat hoist in a lowered position for permitting a boat to be driven off of the hoist or loaded onto the hoist.
Figure 3:
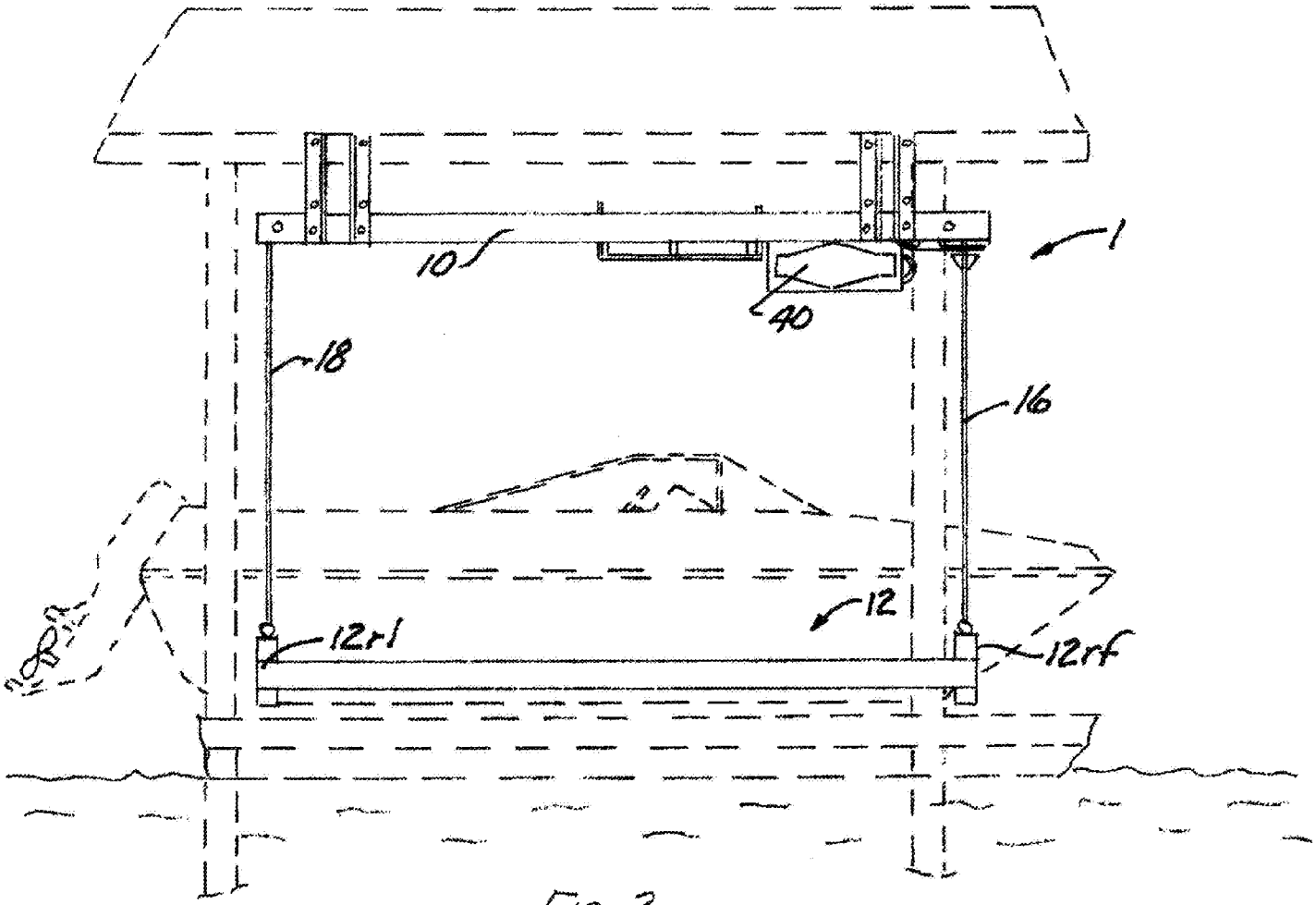
FIG. 3 is a side elevational view like FIG. 2, but showing the boat hoist being raised to the boat storage position shown in FIG. 1.

The boat lift (1) shown in FIGS. 1-4 is shown specifically installed in a boat house shown in dashed lines in FIGS. 1-3. The hydraulic boat lift (1) has a pair of lift tubes (10) and (11) which will be referred to herein first and second elongated members (10) and (11). These elongated members (10) and (11) are attached to structures within the boat house but can also be attached directly to piers for example in the manner shown in FIGS. 12 and 13.

A boat lifting platform (12), shown in FIG. 1 for example, has a front portion with a right front portion (12*rf*) and a front left portion (12*fl*), a rear right portion (12*a*) and a rear left portion (12*rl*). The boat lifting platform (12) has a lowered position below a water line as shown in FIG. 2 and a raised position above the water line as shown in FIGS. 1 and 3.

Figure 15:
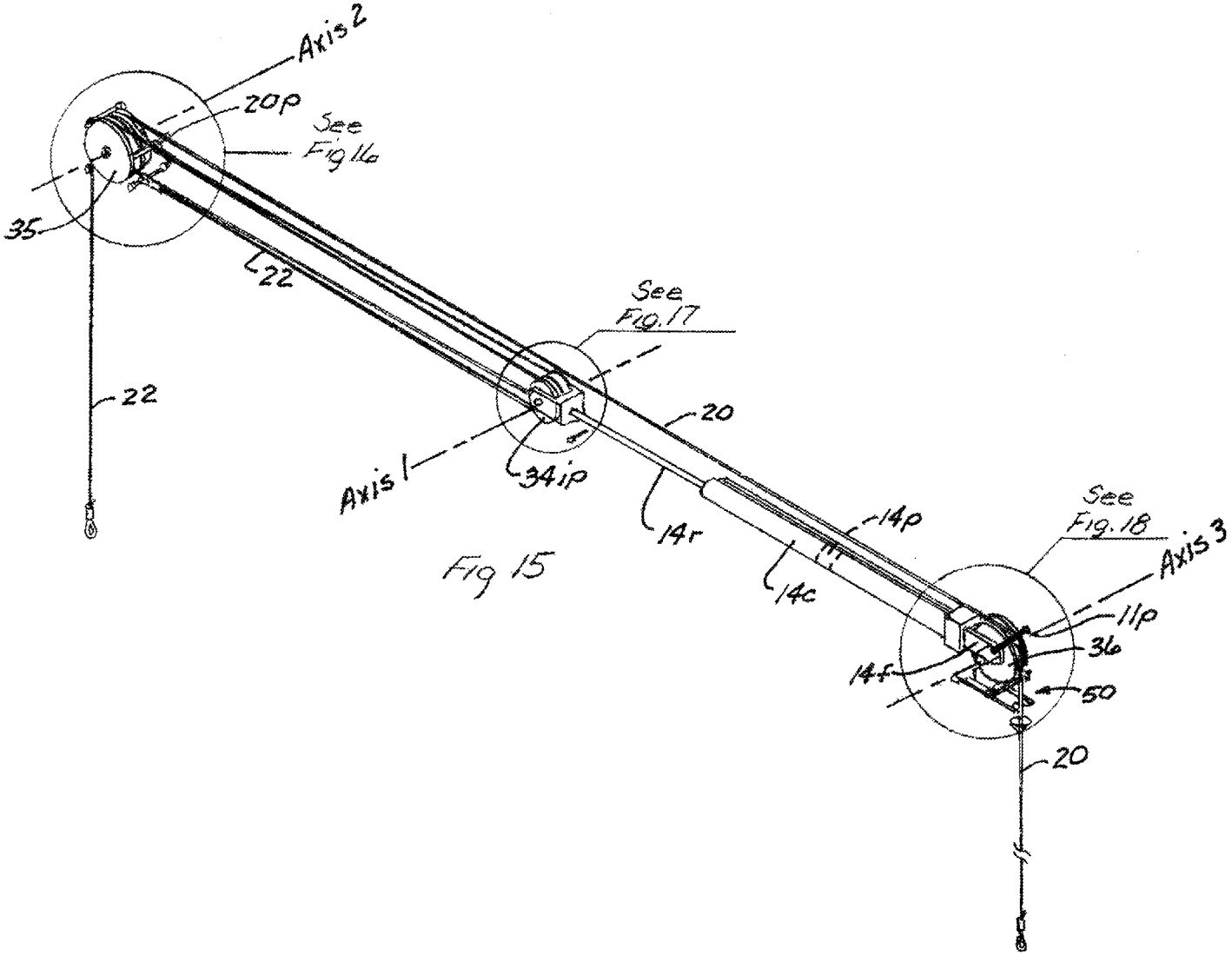
FIG. 15 is a view of what is inside of one of the top hydraulic lift tube assemblies, namely a hydraulic cylinder for moving a pulley block back and forth to cause cables trained over idler pulleys to pull cables up or allow them to be lowered.

Flexible lines or cables (16), (18), (20) and (22) extend from the platform (12) upwardly to mechanisms within the elongated lift tubes/elongated members (10) and (11), the mechanisms being shown in detail in FIG. 15. The FIG. 15 embodiment is showing the elongated member (11) but is to be understood that everything within the elongated member (10) is identical to that shown in the elongated member 11 of FIG. 15 as well.

A hydraulic cylinder (14*c*) is attached at one end to the elongated member (11) by a pin (11*p*) that extends through the tube (11), through openings in flanges (14*f*) of hydraulic cylinder (14*c*) and through an idler pulley (36).

Figure 7:
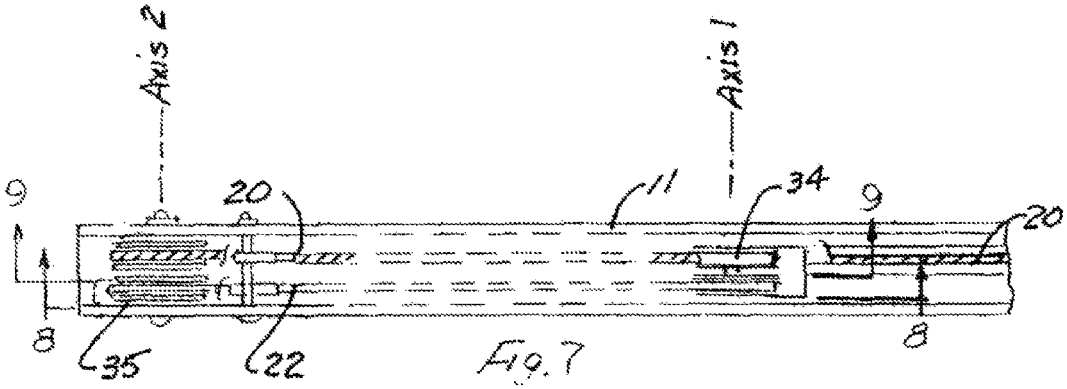
FIG. 7 is a top view of the right end of the hydraulic lift tube assembly as shown in FIG. 6, with portions thereof broken away to show moving parts therein.
Figure 8:
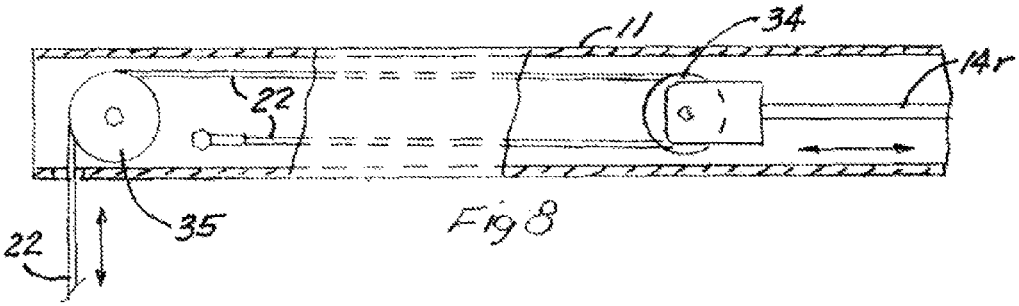
FIG. 8 is a view taken along lines 8-8 of FIG. 7 with portions of the hydraulic lift tube assembly being broken away to show the moving parts inside thereof.
Figure 9:
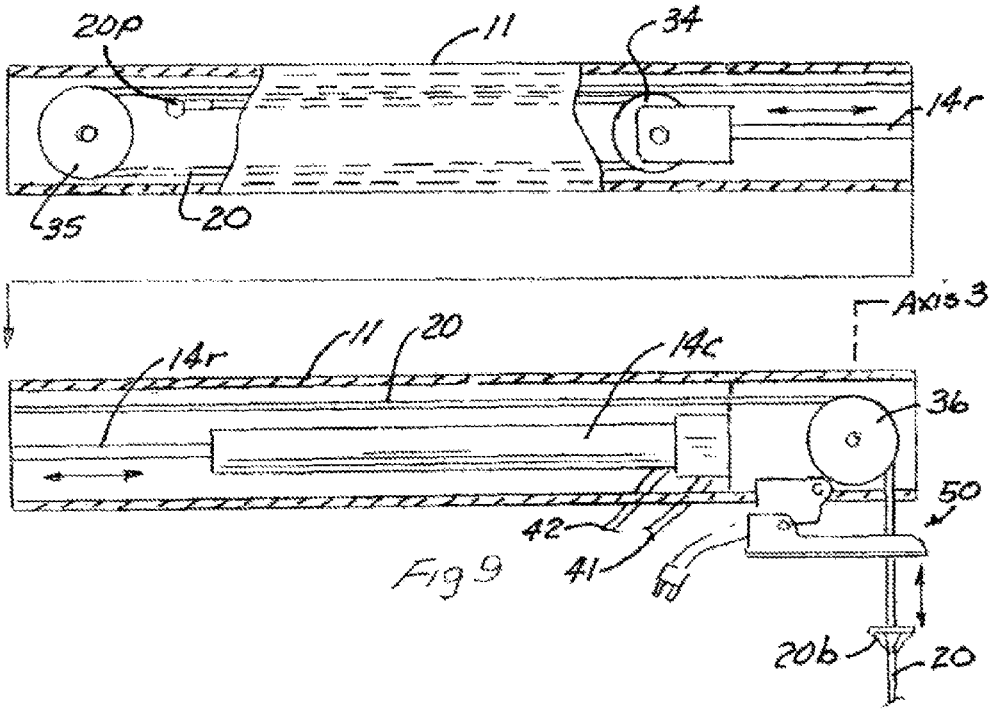
FIG. 9 is a two part view taken along lines 9-9 of FIG. 7.
Figure 18:
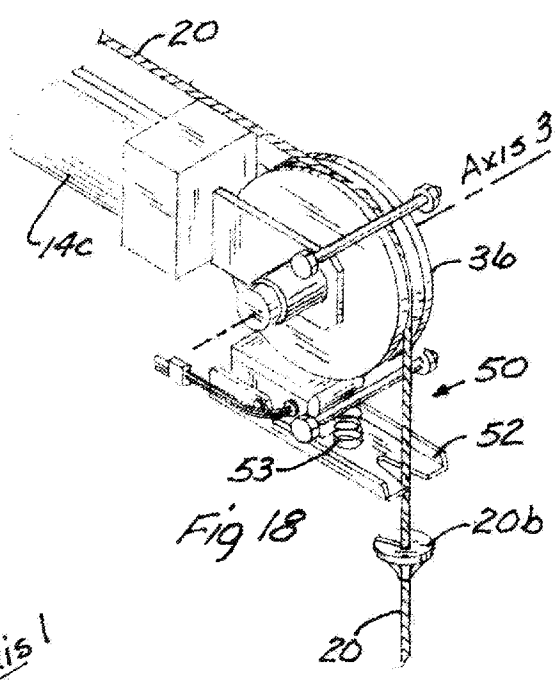
FIG. 18 is an enlarged view of the idler pulley assembly and switch assembly within the circle labeled "See FIG. 18" of FIG. 15.
Figure 16:
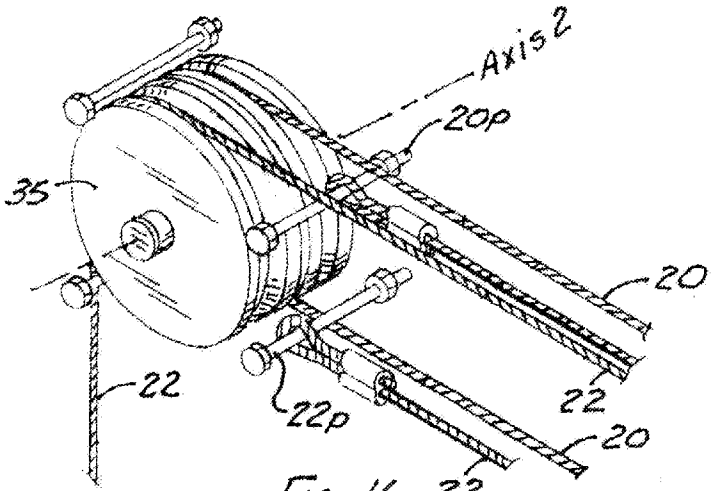
FIG. 16 is an enlarged view of the idler pulley assembly within the circle labeled "See FIG. 16" of FIG. 15.
Figure 17:
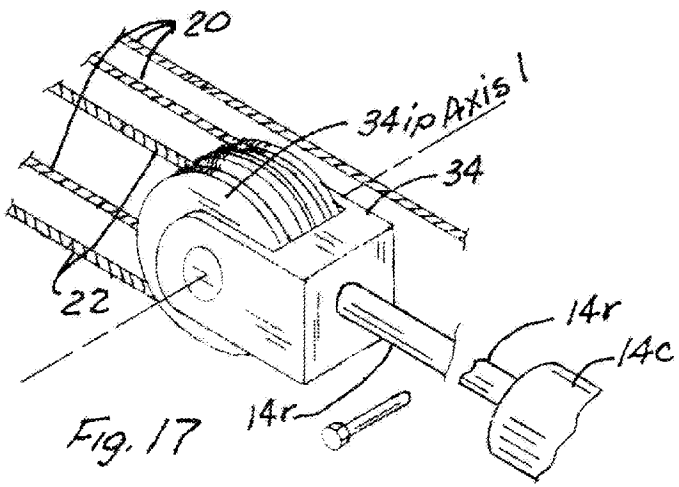
FIG. 17 is an enlarged view of the pulley block assembly within the circle labeled "See FIG. 17" of FIG. 15.

The rod (14*r*) of the hydraulic cylinder (14*c*) has a pulley block (34) attached thereto and flexible lines or cables (20) and (22) are trained around respective idler pulleys (34), (35) and (36) as shown in FIGS. 15-18 as well as in FIGS. 7-9. The cable of flexible line (22) is attached to a pin (22*p*) that extends through the elongated member (11) as can best be seen in FIG. 7. The flexible line (22) then extends over and through a groove in idler pulley (34) before extending back over idler pulley (35) as shown in FIGS. 8 and 15 for example. Another flexible line or cable (20) is attached to the elongated member (11) at pin (20*p*) shown in FIGS. 9 and 15, the pin (20*p*) extending through the elongated member (11). The flexible line (20) is also trained over pull block idler (34), around idler (35) and then over and downward over idler (36) as shown in FIGS. 9, 15 and 18 for example.

Figure 4:
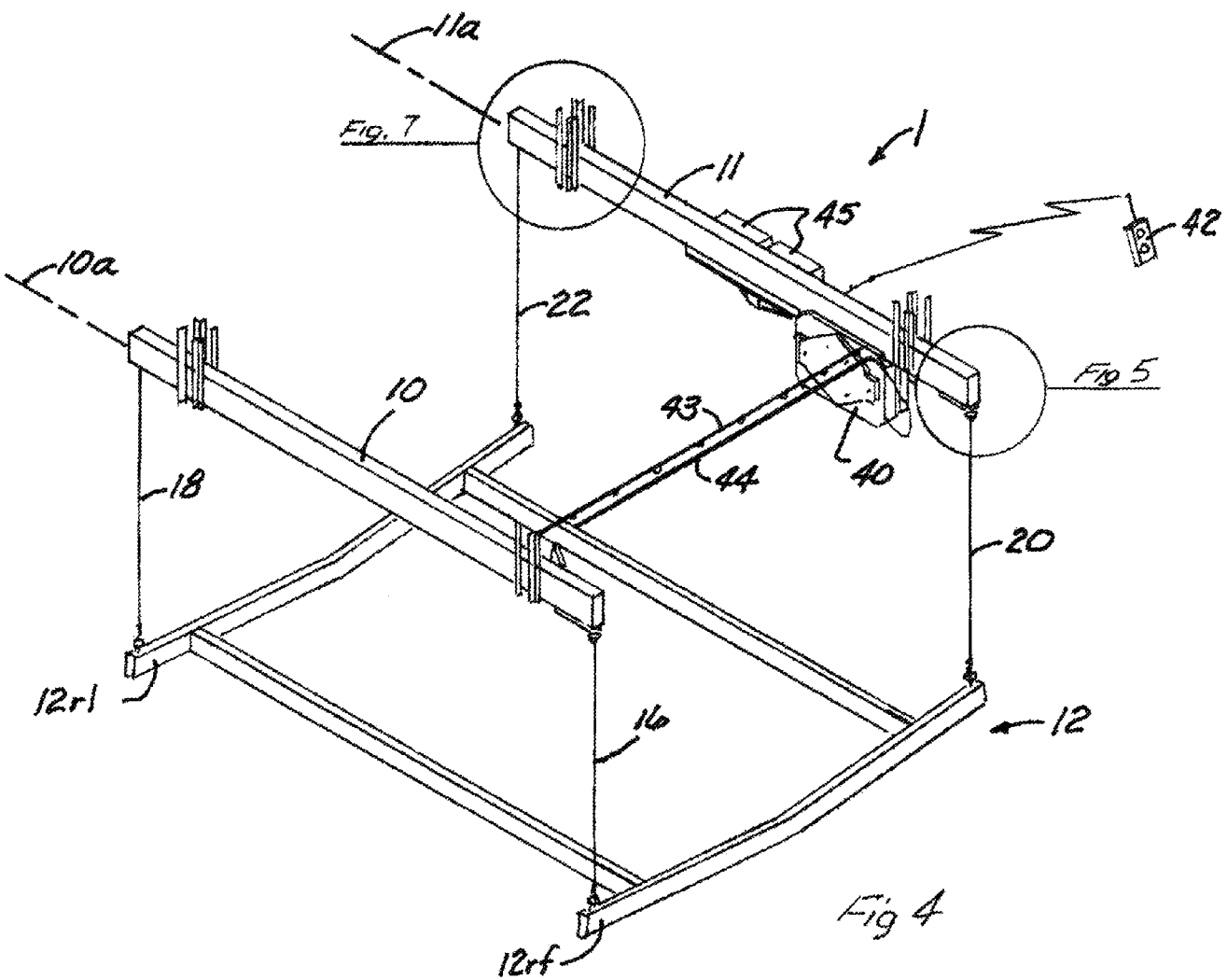
FIG. 4 is a perspective view of the boat hoist of FIGS. 1-3 but not showing a boat house or pier system to which it would be attached to be operational.
Figure 6:
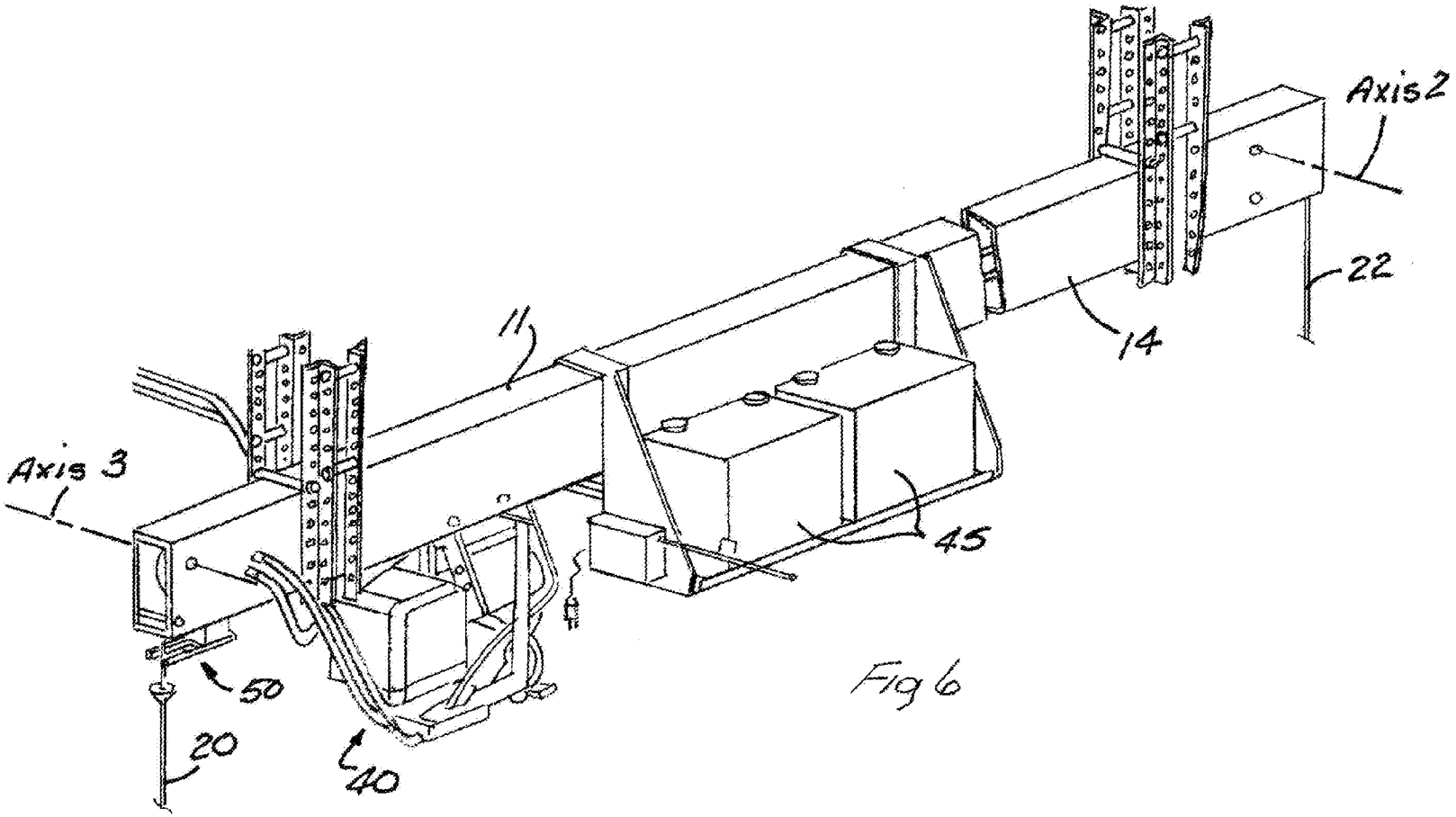
FIG. 6 is an enlarged perspective view of the top right portion of the hoist embodiment shown in FIG. 4 looking from the side of the hoist where the remote control is shown in FIG. 4.
Figure 14:
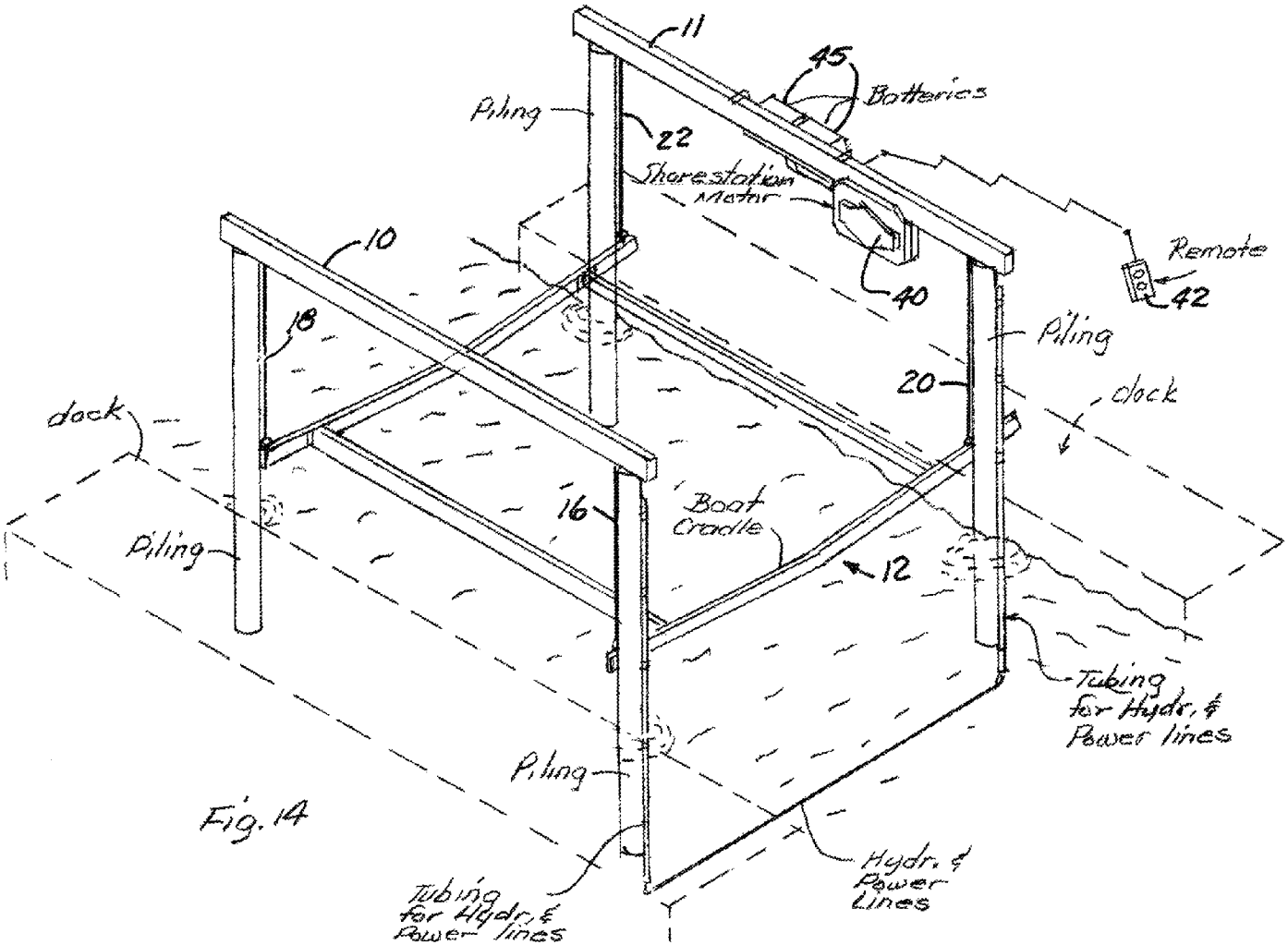
FIG. 14 is a perspective view of the embodiment of FIGS. 11 and 12 shown attached to four spaced apart piers adjacent to a dock.

It will be appreciated by referring to FIG. 15, for example, that as the pulley block (34) moves to the left, the flexible lines (20) and (22) will be lengthened as well to thereby lower the boat lift platform (12) shown in FIGS. 1, 4 and 14 for example and when the hydraulic cylinder (14*c*) is shortened, the pulley block (34) will move to the right as shown in FIG. 15 to shorten the flexible lines (20) and (22) to eventually pull the boat cradle platform (12) up to the position shown in FIGS. 3 and 13 for example. Additionally, it is important to note that in this stored position, the rod (14*r*) will be almost completely retracted inside of the cylinder (14*c*). This is important because that retracted position is the position in which the hydraulic cylinder remains for most of its life because the raised position is when the boat is being stored above the water and the boat will be stored the majority of the time. In most situations the boat itself is being operated on the water a much smaller portion of the time than it is being stored above the water using a boat lift.

Referring again to FIGS. 1-4, attention is directed to a hydraulic control unit (30) mounted on elongated member (11) and having a pair of batteries (45) for powering the unit (40). This unit (40) is shown generally in FIG. 11. The schematic of FIG. 11 includes tandem pumps (201) turned by a motor (M). This tandem pump arrangement shown in FIG. 11 is similar to the system shown in U.S. Pat. No. 7,371,055 to Ohashi, which is incorporated herein by reference in its entirety. This Ohashi device is but one example of a tandem pump of the type used in this invention which drives two hydraulic motors, each of which pumps in the case of Ohashi drives a wheel whereas in the present invention the tandem pumps (201) are driving two hydraulic cylinders (14) as shown in FIGS. 11 and 15.

The hydraulic lines (43) and (44) shown in FIG. 4, for example, are merely to operate the lift cylinder (14) that is inside the lift tube elongated member (10) on the opposite side of the control device (14) shown in FIG. 4.

In operation, the hydraulic boat lift would be in the lowered position shown in FIG. 2 so that a boat like that shown in dashed lines in FIG. 2 could be positioned over the top of the boat cradle (12). Once that occurs, then a remote control (32) can be utilized to actuate the tandem pump motor (M) shown in FIG. 11 to shorten the cylinders (14) by use of the tandem pumps (201) which pump pressurized hydraulic fluid into what would be the left side of a piston (14*p*) within the cylinder (14*c*) as viewed from FIG. 15 while evacuating the hydraulic fluid in the right side of the piston (14*p*). Of course rather than having a double acting hydraulic cylinder (14) a single acting one could be used instead using the weight of the cradle (12) to cause the pulley block (34) to move to the right when fluid is evacuated from the chamber (14*c*) to the left of the piston (14*p*) when viewed in FIG. 15.

As the boat cradle (12) is raised by shortening the hydraulic cylinder (14), a button (20*b*) will move upwardly towards a normally closed switch (50) as shown in FIGS. 5, 5*a* and 18. This normally closed switch (50) which are shown as sw1 and sw2 in FIG. 11 and which also have the reference numerals (50) and (51) thereon permit the pump motor (M) to continue to turn the tandem pumps (201) for shortening the cylinders (14). Once a button (20*b*) on rope (20) pivots a lever (52) from the position shown in FIGS. 5 and 18 to the position shown in FIG. 5*a*, the switch (50), which is identical to the switch (51) sw2 in FIG. 11 as well, will cause the switch (50) to be open and cut off the flow of electricity therethrough. The controller will turn on the motor in the up direction if the limit switch circuit is closed. The switches have to be moved from the FIG. 5 to the FIG. 5*a* position for the circuit to be open, thereby shutting off the motor (M) because these two switches sw1 (50) and sw2 (51) are wired in parallel and are normally closed because of the spring (53) which biases the lever (52) to the FIGS. 5 and 18 position. Once both of the buttons (20*b*) and (16*b*) shown in FIG. 4 have moved from the FIG. 5 to the FIG. 5*a* position, then the pump motor (M) will be off and the boat in its storage or lifted position shown in FIGS. 1, 3 and 13 for example.

Figure 10:
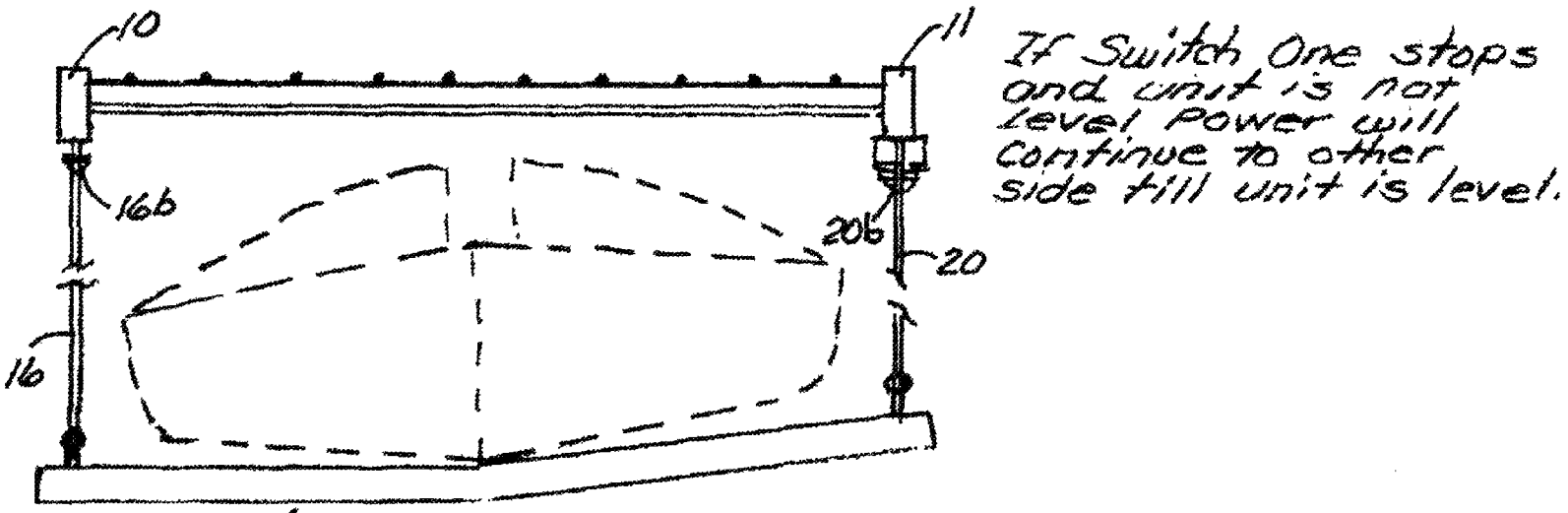
FIG. 10 is a front perspective view of a hydraulic boat hoist showing the right side of the boat lifting platform being slightly higher than the left side thereof and the button on the right front side cable hitting the closed switch on the right side to open that switch while the button on the left side cable has not yet gone up far enough to open the left side switch, which it will automatically do and that action will turn the power off to the tandem pump motor.

FIG. 10 shows the situation where the button (20*b*) hits the lever (52) before the button (16*b*) hits the lever on the other side of the lift. In this case, the pump would still be on until the button (16*b*) moves to the FIG. 5*a* position. Of course the opposite could occur where the button (16*b*) hits the lever (52) and moves it to the FIG. 5*a* position before the button (20*b*) moves to the FIG. 5*a* position. This wiring and switching arrangement does help to synchronize and keep the cradle (12) as level as possible.

Those skilled the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

I claim:

1. A boat lift comprising:

a first elongated member disposed generally along a first horizontal axis;

a second elongated member disposed generally along a second horizontal axis, the second horizontal axis being generally parallel to and at the same general elevation as the first horizontal axis;

a boat lifting platform disposed below the first and second elongated members, the boat lifting platform having a front right portion, a front left portion, a rear right portion and a rear left portion, the boat lifting platform having a lowered position below a waterline and a raised position above the waterline;

a first hydraulic cylinder operatively attached to the first elongated member;

a second hydraulic cylinder operatively attached to the second elongated member;

at least a first flexible line operatively connected to the first hydraulic cylinder and to the front right portion of the boat lifting platform and to the rear right portion of the boat lifting platform, the first hydraulic cylinder having a first position corresponding to the lowered position of the boat lifting platform and a second position corresponding to the raised position of the boat lifting platform;

at least a second flexible line operatively connected to the second hydraulic cylinder and to the front left portion of the boat lifting platform and to the left rear portion of the boat lifting platform, the second hydraulic cylinder having a first position corresponding to the lowered position of the boat lifting platform and a second position corresponding to the raised position of the boat lifting platform;

a source of pressurized hydraulic fluid to for selectively moving the first and second hydraulic cylinders between their respective first and second positions thereof for causing a corresponding change in the position of the boat lifting platform between the lowered position and the raised position thereof; and wherein the source of pressurized hydraulic fluid for the first and second hydraulic cylinders comprises a synchronized tandem hydraulic power unit which simultaneously delivers substantially the same amount of fluid to each of the first and second hydraulic cylinders in a synchronized fashion.

2. The boat lift of claim 1 wherein the at least one first flexible line comprises a first cable operatively attached to the first hydraulic cylinder and to the front right portion of the boat lifting platform and a second cable connected to the rear right portion of the boat lifting platform.

3. The boat lift of claim 2 wherein the at least one second flexible line comprises a third cable operatively attached to the second hydraulic cylinder and to the front left portion of the boat lifting platform and a fourth cable connected to the rear left portion of the boat lifting platform.

4. The boat lift of claim 3 wherein:

the first hydraulic cylinder has a first idler pulley operatively rotatably attached to one end thereof along a first rotary axis;

a second idler pulley is operatively rotatably attached to the first elongated member along a second rotary axis;

a third idler pulley is operatively rotatably attached to the first elongated member along a third rotary axis;

the first cable being trained over the second idler pulley and around the first idler pulley, the first cable being further attached to the first elongated member at a place generally between the first and second idler pulleys;

the second cable being trained over the second and third idler pulleys and around the first idler pulley, the second cable being further attached to the first elongated member at a place generally between the first and second idler pulleys; and wherein the first and second rotary axes are to one side of one end of the first hydraulic cylinder and the third axis is on the other side of the other end of first hydraulic cylinder.

5. The boat lift of claim 4 wherein the first hydraulic cylinder is pivotally attached to the elongated member along the third axis.

6. The boat lift of claim 4 wherein the at least one second flexible line comprises a third cable operatively attached to the second hydraulic cylinder and to the front left portion of the boat lifting platform and a fourth cable connected to the left right portion of the boat lifting platform.

7. The boat lift of claim 6 wherein:

the second hydraulic cylinder has a fourth idler pulley operatively rotatably attached to one end thereof along a fourth rotary axis;

a fifth idler pulley is operatively rotatably attached to the second elongated member along a fifth rotary axis;

a sixth idler pulley is operatively rotatably attached to the second elongated member along a sixth rotary axis;

the third cable being trained over the fifth idler pulley and around the fourth idler pulley, the third cable being further attached to the second elongated member at a place generally between the fourth and fifth idler pulleys;

a the fourth cable being trained over the fifth and sixth idler pulleys and around the fourth idler pulley, the fourth cable being further attached to the second elongated member at a place generally between the fourth and fifth idler pulleys; and wherein the fourth and fifth axes are to one side of one end the second hydraulic cylinder and the sixth axis is on the other side of the other end of second hydraulic cylinder.

8. The boat lift of claim 4 wherein the second hydraulic cylinder is pivotally attached to the second elongated member along the sixth axis.

9. The boat lift of claim 1 further comprising a first normally on electrical switch selectively connecting a source of electrical power to the tandem hydraulic power unit based on the position of the first flexible line with respect to the first elongated member;

a second normally on electrical switch selectively connecting the source of electrical power to the tandem hydraulic power unit based on the position of the second flexible line with respect to the second elongated member; and wherein the first and second electrical switches are connected in parallel between the source of power and the tandem hydraulic power unit so that when either or both of the first and second electrical switches are closed the tandem hydraulic power unit operates to deliver hydraulic fluid under pressure to the first and second hydraulic cylinders and when both of the first and second electrical switches are open the tandem hydraulic power unit is off, thereby ensuring that both the left and right sides of the boat lifting platform have been lifted to a predetermined height in the raised position thereof.

* * * * *